US007404609B2

(12) United States Patent
Nielsen

(10) Patent No.: US 7,404,609 B2
(45) **Date of Patent: *Jul. 29, 2008**

(54) FURNITURE SYSTEM ENCLOSING ENTERTAINMENT ELECTRONICS IN RANGE OF WIDTHS

(75) Inventor: Andreas K. Nielsen, Valley Center, CA (US)

(73) Assignee: Furniture Designs by Aspen (Mauritius) Limited, Port Louis (MU)

( * ) Notice: Subject to any disclaimer, the term of this patent is extended or adjusted under 35 U.S.C. 154(b) by 0 days.

This patent is subject to a terminal disclaimer.

(21) Appl. No.: 10/925,355

(22) Filed: Aug. 23, 2004

(65) Prior Publication Data

US 2005/0082953 A1 Apr. 21, 2005

Related U.S. Application Data

(62) Division of application No. 10/198,204, filed on Jul. 17, 2002, now Pat. No. 6,796,622.

(51) Int. Cl.
*A47B 45/00* (2006.01)

(52) U.S. Cl. ..... 312/205; 312/7.2

(58) Field of Classification Search ..... 312/205, 312/7.2, 111, 257.1, 107; 108/39, 65; 220/8
See application file for complete search history.

(56) References Cited

U.S. PATENT DOCUMENTS

| | | | | |
|---|---|---|---|---|
| 1,928,936 A | | 10/1933 | Henricson | |
| 3,353,885 A | | 11/1967 | Hanson | |
| 3,726,535 A | | 4/1973 | Longato | |
| 3,936,106 A | | 2/1976 | Harper | |
| 4,102,275 A | * | 7/1978 | Spound et al. | 108/92 |
| 4,274,685 A | | 6/1981 | Bradshaw | |
| 4,318,575 A | | 3/1982 | Redlich | |
| 4,491,375 A | | 1/1985 | Ugalde | |
| 4,500,146 A | * | 2/1985 | Peterson | 312/257.1 |
| 4,669,790 A | | 6/1987 | Briggs | |
| 4,987,706 A | | 1/1991 | Hughes et al. | |
| 5,125,725 A | | 6/1992 | Blunt | |
| 5,137,160 A | * | 8/1992 | Santucci | 211/153 |
| 5,147,122 A | | 9/1992 | Short | |
| 5,158,344 A | | 10/1992 | Thurston | |
| 5,303,057 A | | 4/1994 | Davidow et al. | |

(Continued)

FOREIGN PATENT DOCUMENTS

| | | | |
|---|---|---|---|
| CH | 63474 | 2/1913 | 312/205 |

(Continued)

*Primary Examiner*—James O Hansen
(74) *Attorney, Agent, or Firm*—Allen J. Moss; Squire, Sanders & Dempsey, L.L.P.

(57) ABSTRACT

An entertainment center includes a base that expands horizontally to accommodate different width home theater displays;and, a light bridge that rests on top of one or more cabinets placed on either side of the base. The side cabinets provide a vertical column of open space for accommodating wiring among the entertainment system components and ventilation for heat generated by those components. The base includes casters to facilitate moving the base in and out from between the side cabinets. Sliding portions of the base extend horizontally yet continue to transfer all load weight onto the casters. The front woodwork of the base presents a pleasing seamless appearance as a consequence of overlapping trim pieces.

16 Claims, 4 Drawing Sheets

U.S. PATENT DOCUMENTS

| | | | | |
|---|---|---|---|---|
| 5,313,276 | A | 5/1994 | Taaffe | |
| 5,383,721 | A | 1/1995 | Thomas | |
| 5,421,646 | A * | 6/1995 | McNamara et al. | 312/205 |
| 5,795,041 | A | 8/1998 | Weaver | |
| 5,842,758 | A | 12/1998 | Kelley | |
| 6,030,060 | A | 2/2000 | Drake | |
| 6,048,044 | A | 4/2000 | Biggel et al. | |
| 6,079,804 | A | 6/2000 | Draheim | |
| 6,126,253 | A | 10/2000 | Kelley et al. | |
| 6,149,253 | A | 11/2000 | Talasani | |
| 6,209,974 | B1 | 4/2001 | Goto et al. | |
| 6,283,563 | B1 | 9/2001 | Lambright et al. | |
| 6,402,272 | B1 | 6/2002 | Kuvshinikov | |
| 6,505,898 | B1 * | 1/2003 | Buchanan et al. | 312/7.2 |
| 2002/0020329 | A1 | 2/2002 | Kowalski | |

FOREIGN PATENT DOCUMENTS

| | | | |
|---|---|---|---|
| DE | 129923 | 4/1902 | 312/205 |
| DE | 161900 | 7/1905 | 312/205 |
| WO | WO 01/80688 | * 11/2001 | |

* cited by examiner

FURNITURE SYSTEM ENCLOSING ENTERTAINMENT ELECTRONICS IN RANGE OF WIDTHS

CROSS-REFERENCE TO RELATED APPLICATIONS

This application is a divisional of and claims priority to U.S. patent application Ser. No. 10/198,204, filed Jul. 17, 2002 now U.S. Pat. No. 6,796,622 by Nielsen.

FIELD OF THE INVENTION

Embodiments of the present invention relate to furniture such as an entertainment center.

BACKGROUND OF THE INVENTION

Component electronics for audiovisual applications conventionally include multiple, free-standing enclosures that receive power and signals from facility wiring and communicate with other components on wired cables or wireless links. Support for numerous components has conventionally been provided by furniture called an entertainment center. A conventional entertainment center may have open shelving and enclosed shelving for supporting and enclosing not only the components but also media used with the components. Such furniture also conventionally provides holes through the back and through the shelving for accommodating the signal cables and power cables associated with the components.

A conventional entertainment center is spaced away from a facility wall to allow cabling to be tucked behind the cabinetry of the entertainment center because provisions for cabling inside the cabinetry of the entertainment center are inadequate. The space between the entertainment center and the facility wall also supplies ventilation air for the components.

The conventional entertainment center provides movable shelving for accommodating consumer electronics assemblies of different vertical height; but, provides fixed horizontal dimensions designed for a maximum component width. Use of a conventional entertainment center is limited by the fixed horizontal width of its design. Users seeking, for example, to accommodate a larger home theater display (e.g., a big screen television set, a rear projection system, or a front illuminated screen) have little recourse but to purchase new furniture in the event the larger width display does not fit the fixed horizontal width provided by an existing entertainment center.

A large market exists for furniture to support consumer electronics. New products of various sizes are launched into this market annually. Without furniture capable of accommodating different horizontal widths, consumers may be reticent to purchase more expensive entertainment center furniture or may forego the acquisition of newer larger components. Consequently, without the present invention, both the consumer electronics and furniture industries face significant economic impairments to growth in sales.

SUMMARY OF THE INVENTION

A furniture system according to various aspects of the present invention includes an enclosure of a first space to be occupied by a home theater display wherein the enclosure, when placed against a facility wall provides a second space open to the top of the furniture system for ventilation of the home theater display.

When the enclosure includes shelving for consumer electronics assemblies, the shelving may be located between a first vertical side and a second vertical side. The first vertical side is adjacent to the display. The second vertical side has a depth greater than the depth of the first vertical side so that a portion of the second space is behind the shelving for ventilation of the consumer electronics assemblies.

Another furniture system according to various aspects of the present invention includes an enclosure of a space to be occupied by a home theater display and a base for transporting the display into and out from the space. The enclosure includes adjustable members that facilitate extending the enclosure to enclose the display at a width of a set of widths.

Another furniture system according to various aspects of the present invention includes an enclosure of a space to be occupied by a home theater display and a base for transporting the display into and out from the space. The base includes adjustable members that facilitate extending the base to support the display at a width of a set of widths.

Another furniture system according to various aspects of the present invention includes a pair of cabinets and a base for supporting a home theater display. The base includes wheels attached to a lower surface of the base to facilitate rolling the base between the cabinets. The base includes at least one section, mechanically coupled to the base that may be placed in one of a set of positions apart from a center of the base to give the base an apparent width that approximates a corresponding width of any of a set of home theater displays of various widths. The section includes a trim surface to block viewing of the wheels from the front of the entertainment furniture system when the section is placed in any position of the set.

The cabinets may include inner sides shorter in depth than outer sides, thereby forming a passage in the rear of the system for ventilation and cabling.

By including a multi-section base, the load weight of the display is efficiently coupled to the wheels for a variety of displays. By including trim pieces that overlap, the overall appearance of the base is improved. When the furniture system further includes a bridge, an overlapping aspect of the bridge relative to the cabinets is aesthetically similar to the overlapping appearance of the base for improved appearance of the furniture system as a whole.

A base, according to various aspects of the present invention, supports a home theater display and includes a stage and at least two sections. The stage and each section provide a respective front surface to block viewing of a space beneath the home theater display and to enhance the appearance of the base. The sections facilitate horizontal positioning relative to each other to establish a width of the base to approximate the width of any one of a set of home theater displays having differing respective widths. The base includes a plurality of wheels in the space that allow movement of the stage and display as a unit on a provided surface.

The stage and sections may be mechanically coupled by slides. Locks may be added to the slides to maintain the selected positioning.

According to various aspects of the present invention, a method is performed to mount a home theater display in a furniture system. The method includes, in any order: adjusting a horizontal width of a base for supporting the home theater display; placing a first cabinet against a facility wall; placing a second cabinet against the facility wall and spaced apart from the first cabinet a width sufficient for the base; and rolling the base between the first cabinet and the second cabinet. By supporting the display on a wheeled base and transporting the display on the base as a unit, access is facilitated to cabling for power and signals to the display. Cabling may be fully connected and routed prior to rolling the base between the cabinets.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

A furniture system according to various aspects of the present invention supports any of a variety of home theater displays of various widths. The furniture system generally encloses a space for locating the home theater display, the space being enclosed on several sides, for example, the left side, the right side, and the top. The furniture system may further enclose a portion of the rear of the space. Enclosing is typically for establishing, improving, or cooperating with the interior design of a room where the home theater display is to be used. The enclosure provides ventilation for the display according to various aspects of the present invention.

The display is supported on a base having wheels to transport the base and display as a unit separate from the enclosure portion of the furniture system. The furniture system is typically arranged to abut each vertical side of the home theater display and present to a front view a continuous series of trim surfaces that substantially hide the wheels from view. When the rear of the furniture system is placed against a facility wall, spaces defined by the enclosure accommodate wiring and ventilation and are easily accessible from the front of the furniture system. Conventional materials and techniques of furniture manufacture may be used in the design and construction of furniture systems of the present invention except as described below.

Figure 1:
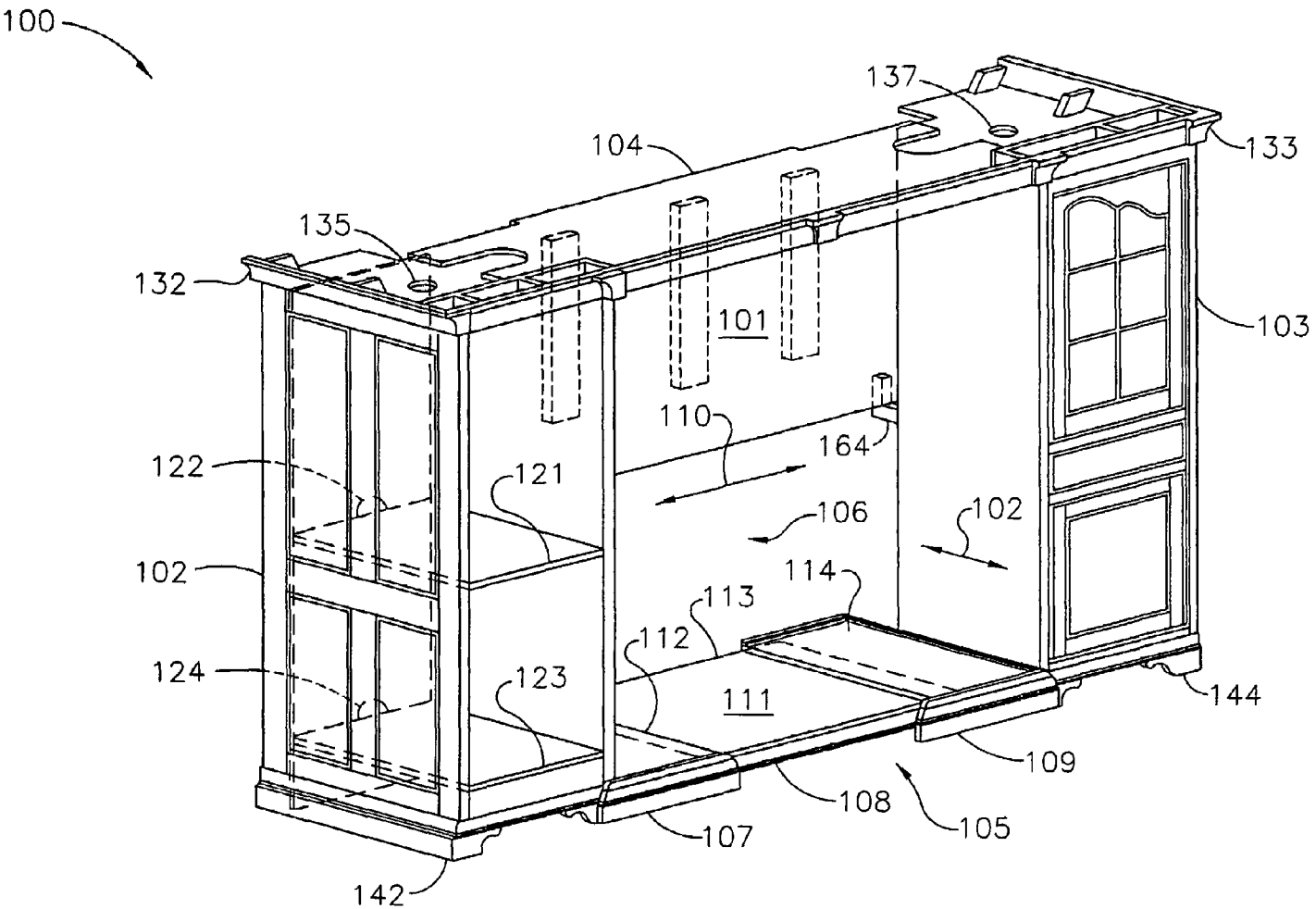
FIG. 1 is a perspective view of a furniture system according to various aspects of the present invention wherein the doors of one of the cabinets are omitted for clarity of presentation.
Figure 2:
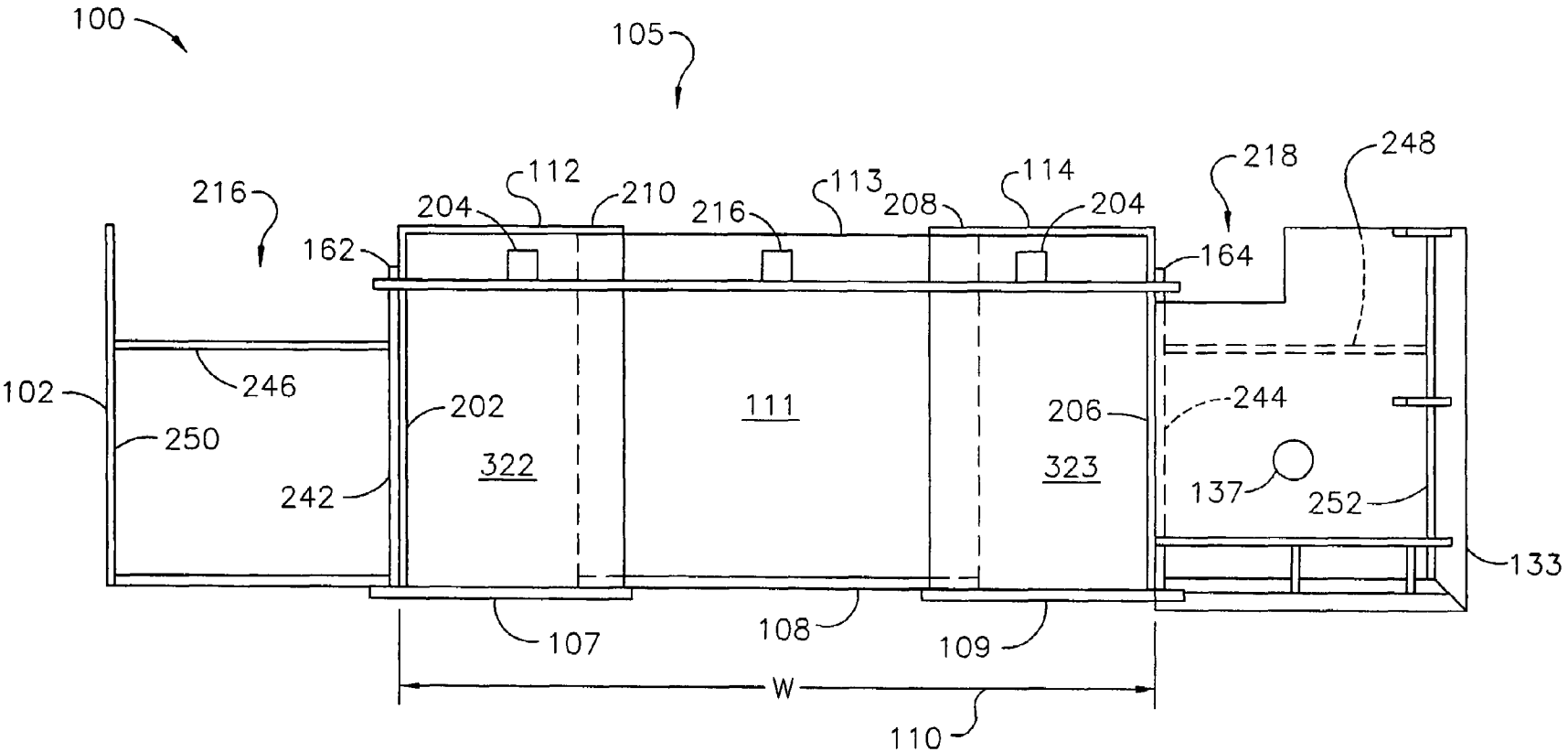
FIG. 2 is a top view of the furniture system of FIG. 1 wherein the bridge and crown of one of the cabinets are omitted for clarity of presentation.
Figure 3:
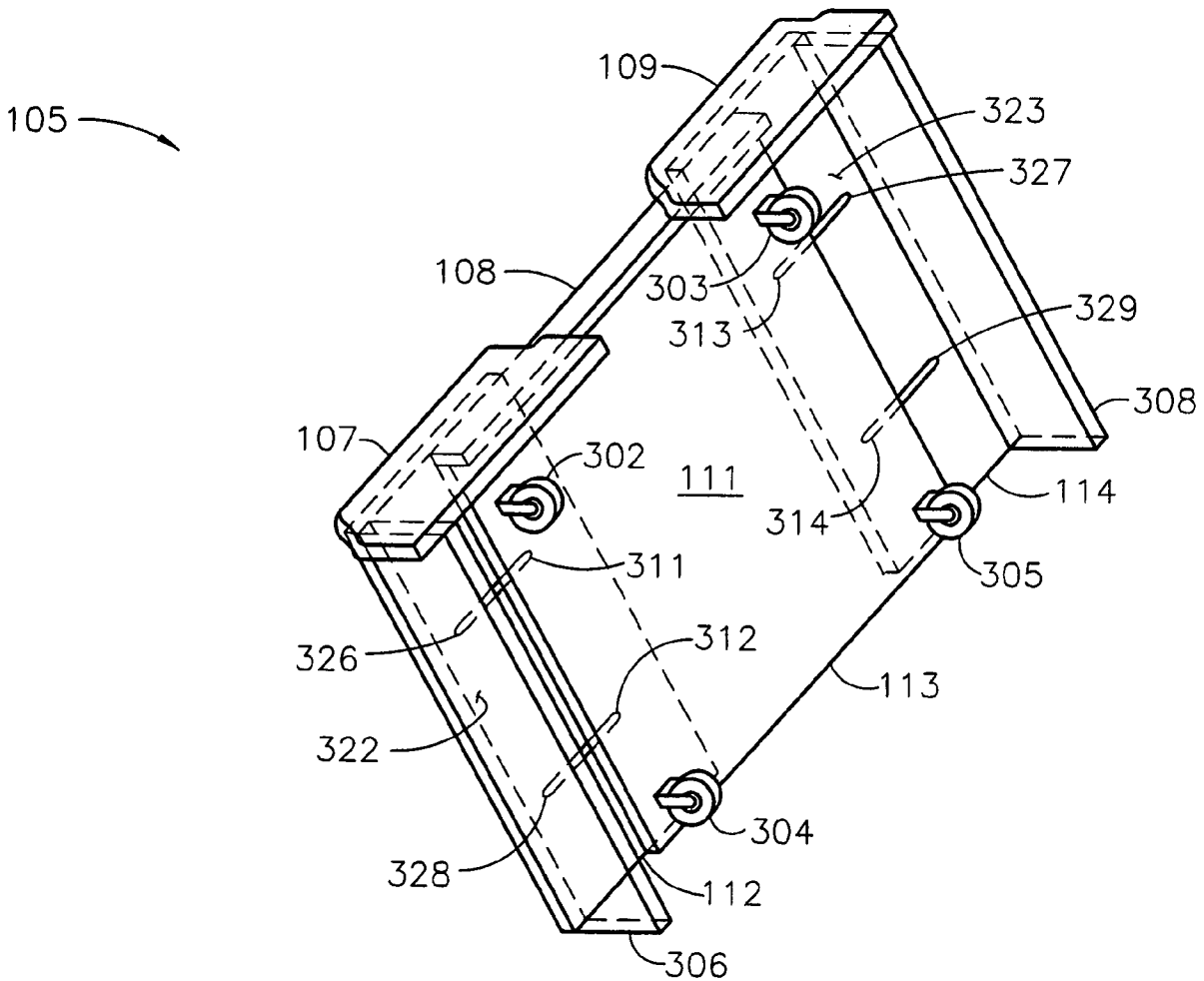
FIG. 3 is a perspective view of the underside of a base for use in the furniture system of FIG. 1.
Figure 4:
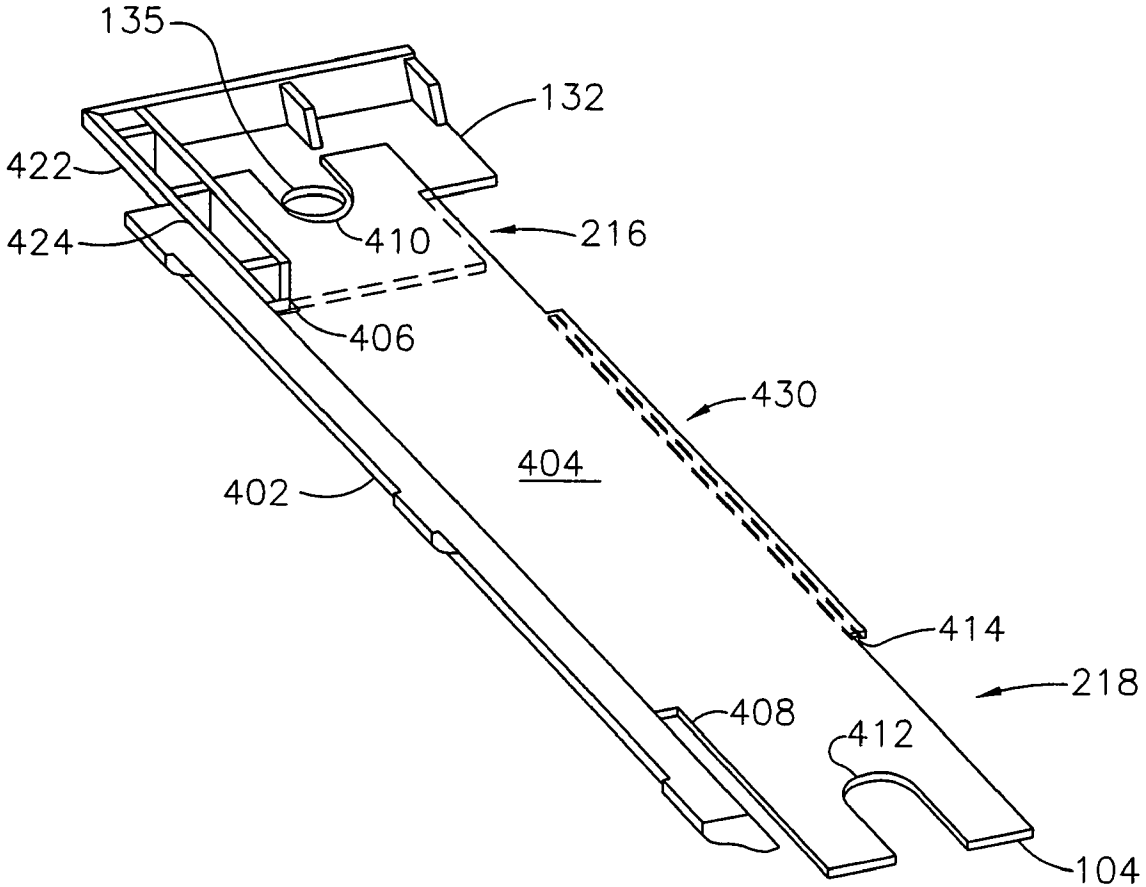
FIG. 4 is a top view of the bridge and a crown of the furniture system of FIG. 1.

For example, furniture system 100 of FIGS. 1-4 includes cabinets 102 and 103, back panel 101, bridge 104, and base 105. Cabinets 102 (and 103) support component electronics and media (not shown). Each cabinet 102 (103) includes inner side 242 (244), outer side 250 (252), crown 132 (133), any number of suitable shelves 121 and 123, and a cabinet back 246 (248) having holes 122 and 124 through which power and signal cables may be routed. Because outer side 250 (252) extends further to the rear than inner side 242 (244), cabinet 102 (103) defines a space 216 (218) for cabling and ventilation.

A back panel of the furniture system enhances the finished appearance and is retained in a vertical position while cabinets 102 and 103 are moved to establish a suitable width 110 for base 105. For example, back panel 101 is mounted to allow cabinets 102 and 103 to be repositioned without access to the rear of the furniture system to effect a change in mounting of back panel 101. Back panel 101 in one implementation rests on a hook 262 (264) on each cabinet 102 (103) and slides in groove 414 of bridge 104. When cabinets 102 and 103 are positioned closer together or farther apart, back panel 101 slides on hooks 262 and 264 and is maintained in a vertical position by groove 414. Back panel 101 does not obstruct cable passage holes (e.g., 122 and 124) or significantly block ventilation holes in cabinet backs 246 and 248 when cabinets 102 and 103 are positioned for a minimum width 110. Back panel 101 includes stiffeners 210, 212, and 214 to reduce warping.

A bridge provides a visual connection between cabinets, usually at the top of a furniture system, by spanning the width between cabinets. While cabinets are moved to establish a suitable width, the bridge cooperates with the cabinets and the back panel to maintain its position on top of the cabinets. The horizontal position of the bridge can be adjusted (e.g., to center the bridge between the cabinets) without access to the top or rear of the furniture system. A bridge may be supported on the front of crowns of two cabinets and may also be supported via a back panel and hooks on which the back panel is supported. A bridge may have a depth when installed that is substantially equal to the depth of the inner sides of cabinets on which it rests.

For example, bridge 104 rests on the top of cabinet 102 and rests on the top of cabinet 103. Bridge 104 nests with back panel 101 in groove 414 to prevent movement of bridge 104 toward the front of furniture system 100. Preferably, back panel 101 bears no weight of bridge 104 so that back panel 101 slides easily when cabinets are moved. Bridge 104 nests with crowns 132 and 133 via slots 406 and 408 to prevent movement of bridge 104 toward the front or toward the rear of furniture system 100. A front surface 422 of crown 132 (and a symmetric surface of crown 133(not shown)) is overlapped by a portion 402 of bridge 104. When surface 422 includes raised or recessed features, corresponding recesses or raised features may be added to surface 424 to provide an integral appearance when surfaces 422 and 424 are pressed against each other. When supported by cabinets 102 and 103, bridge 104 covers a space 106 between cabinets 102 and 103. Bridge 104 may include conventional lighting to illuminate space 106. In one implementation, bridge 104 is not fastened to either cabinet 102 or 103 but slides on the crown portion 132 and 133 of each cabinet so that bridge 104 is aligned easily over the center of space 106 and flush against crowns 132 and 133. Bridge 104 may further include U-shaped slots for avoiding interference between body 404 of bridge 104 and lighting in crowns 132 and 133 (e.g., installed in apertures 135 and 137).

A crown provides an aesthetically pleasing top to a cabinet and provides support for lighting and a bridge. A crown cooperates with a bridge according to various aspects of the present invention to support the bridge while the cabinet is being moved toward or away from the other cabinet on which the bridge is supported. For example, crowns 132 and 133 cooperate with bridge 104 as discussed above. Further, crowns cooperate with a bridge of the present invention to provide an aperture 430 for convection cooling of the home theater display and any entertainment equipment components located within cabinets 102 and 103. Aperture 430 includes a portion 216 rear of cabinet back 246, a portion 218 rear of cabinet back 248, and a portion 430 above base 105. Rear panels, crowns, and/or a bridge of furniture system 100 may include any conventional grills, hole patterns, slots, or voids to facilitate cooling.

A base, according to various aspects of the present invention provides an adjustable width so as to support one of various width home theater displays and provides a concealed mechanism for moving the base in and out of position between cabinets of the furniture system. Such a base includes sections mechanically coupled to each other and capable of being positioned with respect to each other to provide a base having one of various overall widths. Any mechanical coupling technique may be used to provide discrete or continuously variable positions. Concealment of wheels may be accomplished by expandable trim surfaces, where expansion is accomplished by overlapping, telescoping, deploying, or stretching trim surfaces. A deployed trim surface may be stored as rolled stock in the base. Stretching may include elastic, pleated, or accordioned material. For example, base 105 of FIGS. 1-4 includes stage 113, section 112 attached to stage 113 by integral slides, and section 114 attached to stage 113 by integral slides. The stage provides wheels for movement of the base; and the sections and the stage provide cooperative overlapping trim surfaces to conceal the wheels. A trim surface of each section overlaps a portion of the nearest cabinet that abuts the base.

A stage provides support for at least one section and provides transportation for an object placed on the stage or on the section. For example, stage 113 includes platform 111, casters 302-305, studs 311-314, and trim piece 108. Section 112 (114) includes platform 322 (323), side 306 (308), and trim piece 107 (109). Platform 322 (323) includes a pair of slots 326 (327) and 328 (329) for attaching the section to the stage. The underside of section platforms 322 and 323 bears on the an upper side of stage platform 111. Studs 311-314 pass through slots 326-329 to accept a stud termination (e.g., a fender washer and nut). Each slot, stud, and termination cooperate to form a slide for mechanically coupling a section to the stage. By loosening stud terminations, each section 112 and 114 may be moved along its respective slides (e.g., along axis 110) toward and away from the center of platform 111. By moving each section a proportional distance from the center of platform 111, base 113 is extended to any width (W) 110 within the range of the slides. After moving the sections, any suitable lock (e.g., a locking mechanism) may be employed to secure the position, fix the overall width of stage 113, and more efficiently transfer load borne by base 105 to casters 302-305. For example, stud terminations may be tightened to draw and bind the stage and section together.

Casters 302-305 are fixed to an underside surface of platform 111 and provide load bearing support. Each caster pivots around a vertical axis. Each caster provides a wheel that rotates on a horizontal axis. Any conventional caster may be used. A home theater display placed onto base 113 may rest in part against an upper surface of platform 111 and/or on an upper surface of section platforms 322 and 323. Weight of the display is communicated via slides to stage 113 and through casters 302-305 to the facility surface on which furniture system 100 is placed. In operation, casters 302-305 facilitate movement of stage 113 (and a display placed on stage 113) along an axis of width 110 so to align stage 113 between cabinets 102 and 103, and along an axis of depth 120 so to move stage 113 into space 106. A home theater display atop stage 113 may completely fill the width 110 and depth 120 of space 106.

The space directly below stage platform 111 is substantially hidden from view by the cooperation of trim pieces 107-109. Trim piece 107 (109) extends away from the center of platform 111 and beyond the extremity of platform 322 (323) to overlap a portion of cabinet 102 (103) and consequently to cover any portion of space 106 that might remain between base 113 and cabinet 102 (103). Trim piece 107 (109) also extends toward the center of platform 111 to overlap a portion of trim piece 108. When section 112 (113) is slid toward or away from stage 111, trim piece 107 (109) slides in front of trim piece 108 to continue to perform the hiding function.

Each section 112 and 114 may further include a railing on one or more edges of the section to reduce the risk that an object placed on the base will unexpectedly slide off the base. For example, section 112 (114) may further include side 306 (308) that extends above platform 322 (323) to form a lip 202 (206). Railings may be added to the upper surfaces of any platform 111, 322, and/or 323. For example, railing 204 (208) is added on the top rear edge of platform 322 (323).

Movement of base 105 is facilitated in any conventional manner. According to various aspects of the present invention, base 105 provides at least one handle or hand-hold to move base 105. For example, trim piece 108 extends downward yet leaves space for a user to place his or her hand or hands under trim piece 108 and pull on trim piece 108 to move base 105 on depth axis 120 out from between cabinets 102 and 103. In an alternate implementation, platform 111 is formed with a hand access hole through platform 111 to facilitate pulling base 105 on depth axis 120 out from between cabinets 102 and 103.

Assembly of an entertainment system with an entertainment furniture system as discussed above may proceed according to a method performed in any order as follows. Measure the width of the home theater display to be positioned in space 106. Determine whether it is desired to abut both cabinets 102 and 103 to the sides of the home theater display, and if not add a suitable amount to the width. Assemble sections 112 and 114 to stage 113. Before tightening stud terminations, extend each section 112 and 114 symmetrically from the center of stage 113 an amount equal to about half the desired width, then lock the sections to the stage (e.g., by tightening the stud terminations). Place back panel 101 against a facility wall. Place cabinet 102 within a few inches of the facility wall as desired, allowing for access to cable TV, power, telephone, Internet, and other facility wiring connections for use by the entertainment system. Place cabinet 103 roughly the desired width from cabinet 102. Lift back panel 101 onto hooks 162 and 164. Place bridge 104 on top of the crown portions of cabinets 102 and 103, centering bridge 104 over space 106, and fitting bridge 104 onto back panel 101 for maintaining back panel 101 in a vertical position. Move cabinets 102 and/or 103 to obtain the desired width of space 106. While cabinets 102 and 103 are being moved apart (or together), back panel 101 is confined to slide on axis 120 while being maintained in a vertical position; and, bridge 104 is confined to slide only on axis 120 while being maintained square to the top of cabinets 102 and 103. If cabinet lighting is provided in bridge 104 or crown portions of cabinets 102 and 103, connect power wiring. Place a home theater display on base 105 and transport the base and display as a unit to a position in front of space 106. Place all other entertainment system components (e.g., tuner, amplifier, audio media player, speakers) in cabinets 102 and 103. Route all cables and wiring from the display to the components. Reach around cabinet inner side 242 (244) to access cables passing through holes 122 and 124 (and suitable holes in cabinet back 248 (not shown)). Transport the base and display as a unit into space 106 until the trim pieces 107 and 109 meet and overlap a portion of the front trim pieces 142 and 144 of cabinets 102 and 103.

Another furniture system according to various aspects of the present invention may include a base as discussed above and an enclosure. The enclosure may include: (a) shelving to one side of a space to be occupied by the base; and (b) a vertical panel on the opposite side of the space. The enclosure may include a bridge and/or a back panel that spans the top and/or rear sides of the space. For example, such a furniture system may include all of the structures discussed above with reference to system 100, except that: (a) cabinet 102 is replaced by a panel similar to side 250 (e.g., omitting crown, doors, drawer, shelves, as well as front, inside, and rear structures) and supported by being attached to either a back panel similar to 101 and/or to a bridge similar to 104; and (b) bridge 104 is replaced with a bridge modified to attach to or cooperate with side 250 (e.g., omitting all of the structure associated with resting on top of and cooperating with a full size cabinet 102). The structures and cooperation of the bridge and cabinet 103 would be included in this alternate furniture system. The asymmetric implementation discussed here (cabinet to the right of display) may be implemented as a mirror image (cabinet on left of display) in an alternate implementation.

In alternative implementations of the furniture systems discussed above, cabinet doors and drawers are partially or entirely omitted. In still further alternate implementations, any arrangement of shelving, doors, and/or drawers may be located between sides 244 and 252 (and/or sides 250 and 242 if implemented).

Another alternate furniture system according to various aspects of the present invention includes merely a base as discussed above (cabinets 102 and 103, bridge 104, and back panel 101 are omitted).

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A furniture system comprising:

first means for supporting a plurality of provided consumer electronic assemblies on shelving;

second means for enclosing, on a plurality of sides, a space that is horizontally adjacent to the first means; and third means for supporting a provided home theater display in the space, the third means comprising:

fourth means for supportive contact with a first portion of the display;

fifth means for supporting contact with a second portion of the display; and sixth means for coupling the fourth means and the fifth means at a first width of a set of widths there between.

2. The furniture system of claim 1 wherein the first means comprises a cabinet to enclose the shelving, the cabinet comprising a first side adjacent to the space and a second side, wherein the second side has a depth greater than a depth of the first side.

3. The furniture system of claim 1 wherein a portion of the second means takes a different position in relation to the first means when a width of the space is changed to accommodate in the space the third means having a second width of the set of widths.

4. The furniture system of claim 1 wherein the second means comprises a panel that covers at least a vertical portion of a back side of the space to accommodate in the space the third means having any width of the set of widths.

5. The furniture system of claim 1 wherein the second means comprises a bridge that covers at least a horizontal portion of a top side of the space to accommodate in the space the third means having any width of the set of widths.

6. The furniture system of claim 1 wherein the sixth means comprises a slide.

7. The furniture system of claim 1 wherein the sixth means comprises an extensible slide and means for locking the slide at any of a plurality of extensions.

8. The furniture system of claim 1 wherein the third means further comprises a plurality of casters, each caster able to rotate about a respective vertical axis.

9. The furniture system of claim 1 wherein the third means further comprises a plurality of wheels for transportation of the third means across a provided surface.

10. The furniture system of claim 1 wherein the third means further comprises a handle for manually urging transportation of the third means across a provided surface.

11. The furniture system of claim 1 wherein the third means further comprises a hand hold for manually urging transportation of the third means across a provided surface.

12. A furniture system comprising:

a pair of cabinets, each having a top portion and a bottom portion;

a base for positioning adjacent to the bottom portions of the pair of cabinets to support a provided home theater display between the cabinets, wherein the base comprises at least two portions mechanically coupled together to be placed apart from each other at one of a set of positions, each portion for supportive contact with a provided home theater display, the base having a width of a set of widths for supporting one of a variety of provided home theater displays of various widths;

a panel located between the cabinets to cover at lease a portion of a back of a space between the cabinets occupied by the base at any of the set of widths of the base; and a bridge having a groove retaining the panel;

wherein the panel is supported in sliding contact with each cabinet.

13. The system of claim 12 wherein the at least two portions each comprise a respective trim surface to block view to a respective space beneath the system when the portions are placed at any position of the set of widths.

14. The system of claim 12 wherein the portions comprise respective members of a slide that mechanically couples the portions together.

15. The system of claim 12 wherein:

a cabinet of the pair of cabinets has an inner side and an outer side; and a depth of the outer side is greater than a depth of the inner side sufficient to provide ventilation and passage for provided cables from within the cabinet to the provided home theater display.

16. The system of claim 12 wherein the base further comprises a plurality of wheels for moving the base across a provided surface.

* * * * *